US006082731A

United States Patent [19]

Yamazaki

[11] Patent Number: 6,082,731

[45] Date of Patent: Jul. 4, 2000

[54] MEDIUM PROCESSING APPARATUS AND A MEDIUM POSITIONING MECHANISM

[75] Inventor: Tsuyoshi Yamazaki, Kawasaki, Japan

[73] Assignee: Fujitsu Limited, Kawasaki, Japan

[21] Appl. No.: 09/139,559

[22] Filed: Aug. 25, 1998

[30] Foreign Application Priority Data

Mar. 19, 1998 [JP] Japan ..... 10-070776

[51] Int. Cl.[7] ..... B65H 9/00

[52] U.S. Cl. ..... 271/240; 271/253; 271/258.01; 271/262; 271/265.01

[58] Field of Search ..... 271/240, 253, 271/258.01, 262, 263, 265.01, 265.04

[56] References Cited

U.S. PATENT DOCUMENTS 5,516,093 5/1996 Ballard et al. ..... 271/240
5,533,721 7/1996 Takashimizu ..... 271/240 X

FOREIGN PATENT DOCUMENTS 1-242326 9/1989 Japan .
2-282135 11/1990 Japan .
616248 1/1994 Japan ..... 271/240
648616 2/1994 Japan ..... 271/240

*Primary Examiner*—David H. Bollinger
*Attorney, Agent, or Firm*—Armstrong, Westerman, Hattori, McLeland & Naughton

[57] ABSTRACT

A medium processing apparatus includes a medium feed path in a main body of an medium processing apparatus, a medium positioning mechanism provided in the main body of the medium processing apparatus adjacent to the medium feed path for causing a centering of the medium in the medium feed path, and a medium processing unit provided in the main body of the medium processing apparatus adjacent to the medium feed path, wherein the medium positioning mechanism forms a unit independent from the main body of the medium processing apparatus, and wherein the medium positioning mechanism includes an adjustment mechanism for adjusting a position of the medium positioning mechanism with respect to the main body of the medium processing apparatus.

7 Claims, 8 Drawing Sheets

MEDIUM PROCESSING APPARATUS AND A MEDIUM POSITIONING MECHANISM

BACKGROUND OF THE INVENTION

The present invention generally relates to medium processing apparatuses and more particularly to a medium processing apparatus capable of printing on various media and a medium positioning mechanism used in such a medium processing apparatus.

Today, an institution, typically a financial institution or a local government office, has to issue various types of certificates. In order to handle the complicated process of issuing these certificates, there is a need for a printing apparatus that is capable of printing various different documents such as a certificate or a bankbook that have various different sizes. In other words, there is a need of a printing apparatus that is capable of printing on various forms called hereinafter a "medium." The process of printing on such a medium will be referred to hereinafter as "processing."

As such a medium processing apparatus uses a general purpose printer for printing letters on a medium, it is necessary to align the medium with respect to the printer such that the medium is positioned in alignment with the range in which the printer is capable of printing. Such a positioning of the medium with respect to the printer is particularly important for a medium such as a bankbook that is inserted manually to the printer by inexperienced user.

In view of the foregoing, conventional medium processing apparatuses generally include a positioning mechanism for positioning the medium on which a printing is to be made such that the medium is aligned properly with respect to the printer in the printing apparatus.

Conventionally, the positioning mechanism used in such a medium processing apparatus has achieved the necessary positioning of the medium by aligning a lateral edge of the medium to a predetermined reference position of printing conducted by the printer. For example, the medium to be fed into the printer is urged to the left or right in the medium feed path such that a left edge or a right edge of the medium is aligned to the reference printing position of the printer.

In view of variously different sizes of the media to be processed by a medium processing apparatus, conventional medium processing apparatuses use such a positioning mechanism also in a feed path of the medium for feeding the medium to the printer. Typically, the medium is urged to the right edge of the feed path for achieving the desired positioning.

On the other hand, such an edge-reference feeding of medium, in which a medium is fed in the state that the medium is urged to the right or left edge of the feed path, tends to cause a problem in that the medium experiences a deformation or jamming as a result of friction caused between the medium and the right or left wall of the feed path to which the medium is urged during the feeding. In order to avoid this problem, recent medium processing apparatuses are going to adopt a center-reference feeding and printing process in which the medium is transported along a center of the feed path and the printing is made about a center-reference position set at the center of the area of printing.

In view of such a center-reference feeding and printing of the medium, there is a need for a medium positioning mechanism for positioning a medium in alignment with a center of the medium feed path.

Other than the foregoing problem, the conventional edge-reference feeding of a medium has a drawback in that, once the medium positioning mechanism is mounted on a medium processing apparatus in alignment with the general purpose printer inside the medium processing apparatus, there is no possibility for adjusting the reference position of medium feeding. Thus, it is not possible to replace the printer to a model other than the currently used one. Whenever the printer is to be replaced with a new printer, there is no choice but to use the same model of printer even when there are various new high-performance model models available.

In addition, the conventional edge-reference feeding process of a medium has a further drawback, in relation to the use of an arm for urging the medium to the right edge wall or left edge wall of the feed path, in that the medium tends to experience a deflection as a result of engagement of the arm from a lateral direction. The deflection of the medium becomes a particularly serious problem in the feed path in which the medium is transported in a flat state. In a flat state of the medium, it should be noted that the medium is particularly vulnerable to deflection when a lateral urging force is applied. The deflection occurring in a medium results in a jamming of the medium in the feed path.

Further, such a conventional medium positioning mechanism that uses an arm for urging the medium has a drawback in that the speed of the lateral positioning of the medium cannot be increased as desired. As the arm is moved laterally with a generally constant speed, such an increase in the speed of the arm would cause a severe deflection in the medium.

Thus, it has been necessary to set the moving speed of the arm to be substantially slower than the speed desired for high speed printing in the conventional medium positioning mechanism.

SUMMARY OF THE INVENTION

Accordingly, it is a general object of the present invention to provide a novel and useful medium processing apparatus wherein the foregoing problems are eliminated.

Another and more specific object of the present invention is to provide a medium processing apparatus processing a medium in a state in which said medium is centered to a reference position, without causing a deformation in said medium.

Another object of the present invention is to provide a medium processing apparatus, comprising:

a main body:

a medium feed path provided in said main body of said medium processing apparatus;

a medium positioning mechanism provided in said main body of said medium processing apparatus adjacent to said medium feed path, said medium positioning mechanism causing a centering of said medium in said medium feed path; and a medium processing unit provided in said main body of said medium processing apparatus adjacent to said medium feed path, wherein said medium positioning mechanism forms a unit independent from said main body of said medium processing apparatus, and wherein said medium positioning mechanism includes an adjustment mechanism for adjusting a position of said medium positioning mechanism with respect to said main body of said medium processing apparatus.

According to the present invention, the medium is aligned to a reference position that is set coincident to the center of the feed path or a position in the vicinity of the center of the medium feed path. Thereby, it is possible to use a printer of the center-reference printing type for the medium processing unit. As the medium positioning mechanism forms an independent unit with respect to the body of the housing, and in view of the fact that the medium positioning mechanism is adjustable with respect to the housing of the medium processing apparatus, the optimum positioning of the medium with respect to the reference position of the medium processing unit can be achieved readily whenever the medium processing unit is replaced.

Other objects and further features of the present invention will become apparent from the following detailed description when read in conjunction with the attached drawings.

DETAILED DESCRIPTION OF THE PREFERRED EMBODIMENTS

Figure 1:
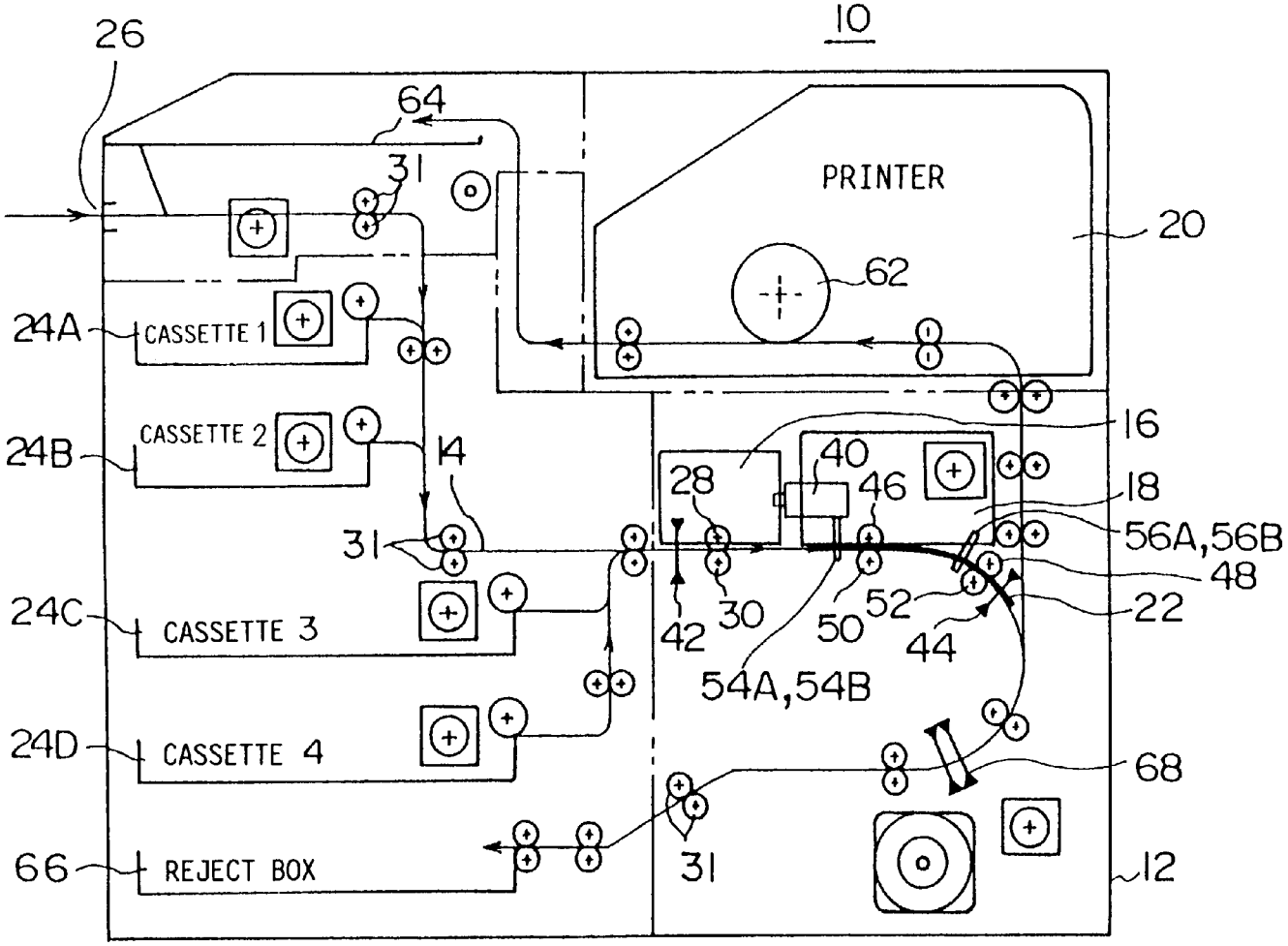
FIG. 1 is a diagram showing the construction of a medium processing apparatus according to an embodiment of the present invention.

FIG. 1 shows the construction of a medium processing apparatus 10 according to an embodiment of the present invention together with a medium positioning mechanism 18 used in the apparatus 10. In the description below, the medium processing apparatus 10 will be described in relation to a printing apparatus used for printing various certificates or bankbooks, wherein the printing apparatus will be designated by the reference numeral 10 in the description hereinafter.

Referring to FIG. 1, the printing apparatus 10 includes a main body 12 in which a medium feed path 14, a double-feed detection mechanism 16, a medium positioning mechanism 18 and a general purpose printer 20 are accommodated, wherein the main body 12 further accommodates therein a plurality of cassettes 24A–24D in a detachable manner. The detachable cassettes 24A–24D are used to hold various media including certificates of different sizes or bankbooks of different sizes (referred to hereinafter as media or medium 22) to be printed. In corresponding to the various types and sizes of the medium 22, the cassettes 24A–24D may have different sizes.

In order to allow manual loading of the media 22 onto the printer 20, the printing apparatus 10 also includes an insertion slot 26 above the top cassette 24A for accepting a manual insertion of the medium 22. Further, there is provided a reject box 66 below the bottom cassette 24D for recovering the medium 22 that has caused a jamming in the feed path. Further, there is provided an exit slot 64 above the manual insertion slot 26 for holding out the medium 22 on which the printing has been made by the printer 20.

Figure 5:
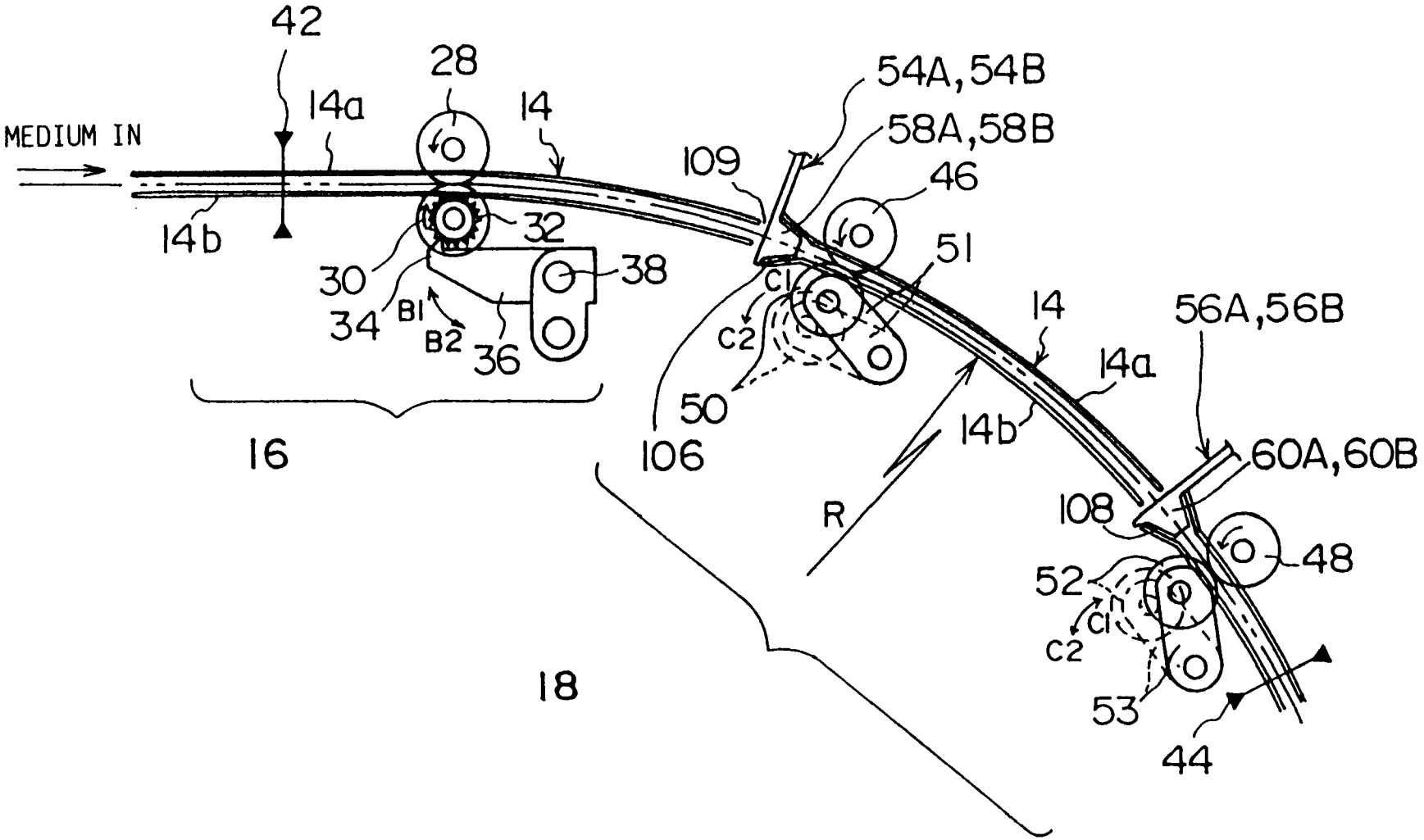
FIG. 5 is a diagram showing a medium feed path used in the medium positioning mechanism of FIGS. 2 and 3.
Figure 6:
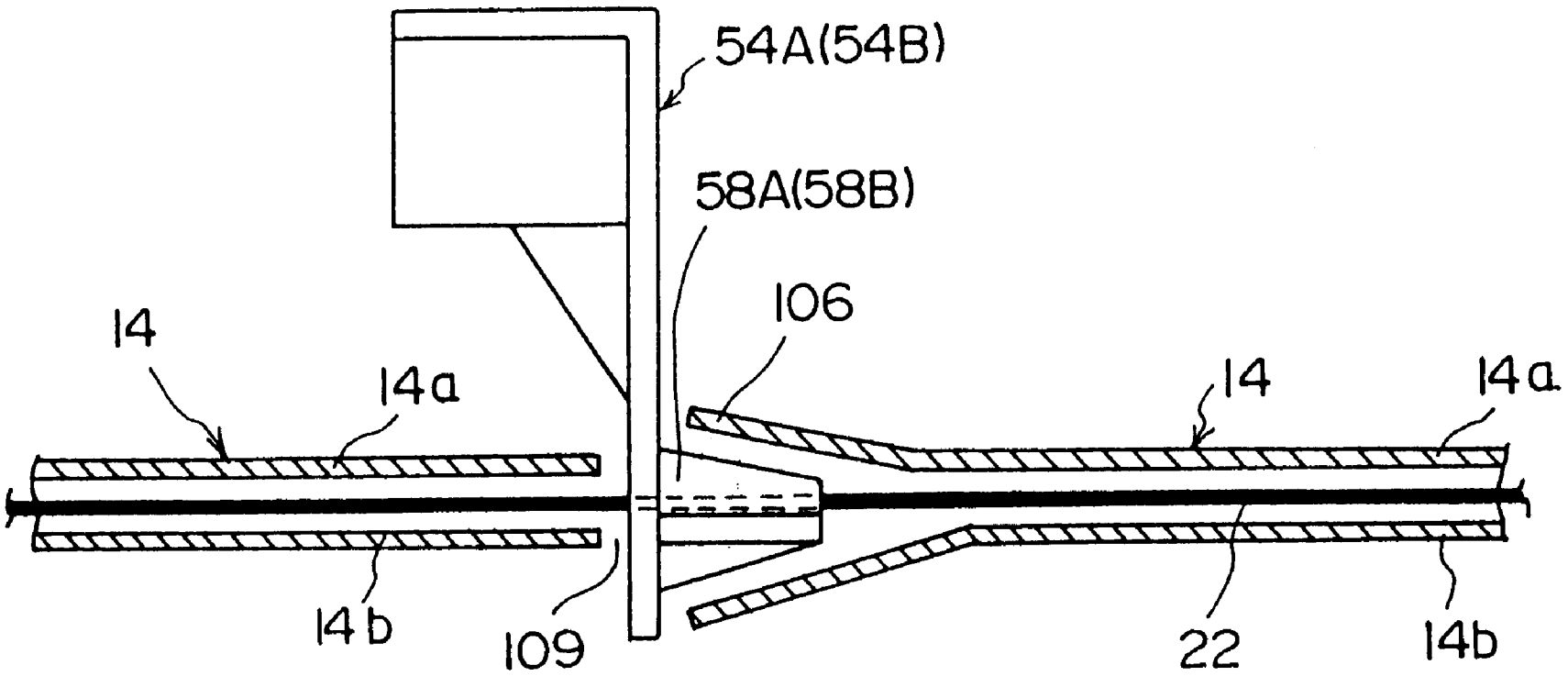
FIG. 6 is a diagram showing the medium feed path in an enlarged scale.

It should be noted that the medium 22, which may have been let out from any of the cassettes 24A–24D or inserted into the manual insertion slot 26, is transported in the main body 12 along a medium feed path 14 and reach the printer 20. As indicated in FIGS. 5 and 6 in an enlarged scale, the medium feed path 14 is formed of a pair of guide plates 14*a* and 14*b* disposed at both sides of the medium feed path 14.

As indicated in FIG. 1, a plurality of guide rollers 31 are disposed at the intermediate position of the medium feed path 14 such that the guide rollers 31 feed the medium 22 through the medium feed path 22 between the guide plates 14*a* and 14*b*.

Further, it should be noted that the double-feed detection mechanism 16 and the medium positioning mechanism 18 are provided at an intermediate position of the medium feed path 14 originating at the cassettes 24A–24D or the manual insertion slot 26 and reaching the printer 20, wherein the double-feed detection mechanism 16 detects the feeding of plural media through the medium feed path 14 in the overlapped state. As indicated in FIG. 5, the double-feed mechanism 16 includes a drive roller 28, a lock roller 30, and first and second double-feed sensors 42 and 44.

The drive roller 28 and the lock roller 30 are both formed of a rubber roller and disposed at both sides of the feed path 14 of the medium 22, wherein the drive roller 28 is driven by a motor not illustrated. The lock roller 30, in turn, carries a coaxial gear 32.

As indicated in FIG. 5, there is provided a lock lever 36 in the vicinity of the gear 32 in a state movable about an axis 38, wherein the lock lever 36 carries a locking claw 34 for engagement with the gear 32. The lock lever 36 is driven by a solenoid 40 shown in FIG. 1 in $B_1$–$B_2$ directions, and prevents the rotation of the lock roller 30 when driven in the $B_1$-direction. In the state in which the lock lever 36 is driven in the $B_1$-direction, it should be noted that the lock claw 34 engages the gear 32. Further, it should be noted that the drive roller 28 continues rotating irrespective of the state of the lock roller 30.

Thus, when two media 22 are transported through the medium feed path 14 in an overlapping state, the upper medium 22 engages the drive roller 28 while the lower medium 22 engages the lock roller 30.

When the rotation of the lock roller 30 is interrupted as explained above in the state in which both of the rollers 28 and 30 engage the respective media 22, the feeding of the lower media 22 engaging the lock roller 30 is interrupted.

On the other hand, the drive roller 28 engaging the upper medium 22 continues rotating irrespective of the state of the lock roller 30 as noted above, and thus, the upper medium 22 is caused to slide over the lower medium 22 by the drive roller 28 and is forwarded further in the downstream direction of the medium feed path 14. Thus, the double feed detection mechanism 16 induces a differential feeding between the uppermost medium 22 and the lowermost medium 22 whenever two media 22 are supplied in the overlapping state.

In order to control the foregoing double-feed detection mechanism 16, the printing apparatus 10 of the present invention uses, as indicated in FIG. 1, first and second double-feed sensors 42 and 44 for detecting the feeding of the medium 22 through the medium feed path 14. Both of the first and second sensors 42 and 44 are formed of a non-contact sensor, wherein the first sensor 42 detects the rear end of the medium 22 and issues a signal in response to the detection of the rear end of the medium 22, while the second sensor 44 is used to detect the time needed for the medium 22 to pass over the sensor 44.

Further, it should be noted that the medium positioning mechanism 18 is disposed in the downstream side of the double-feed detection mechanism 16 on the medium feed path 14 as indicated in FIG. 5. As noted already, the medium positioning mechanism 18 centers the medium 22 fed through the medium feed path 14 laterally. The details of the medium positioning mechanism 18 will be described later.

Figure 4:
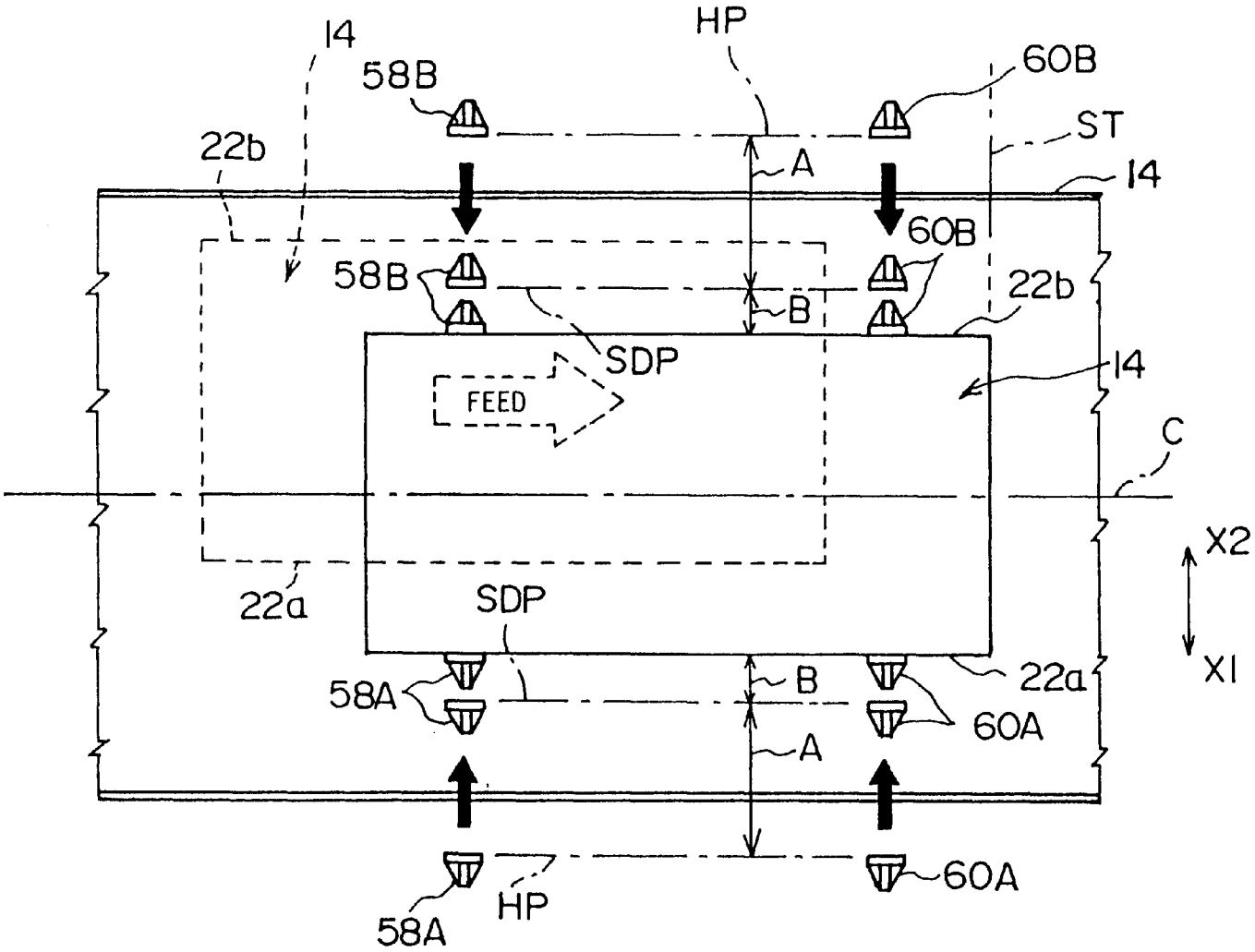
FIG. 4 is a diagram showing the function of the medium positioning mechanism of FIGS. 2 and 3.

The medium 22 thus fed through the medium feed path 14 is finally supplied to the printer 20 shown in FIG. 1, wherein it should be noted that the printer 20 is a general purpose printer that carries out printing about a reference position which is set at the center of the printing area. By adopting such a center-reference printing process, the load of medium feeding is balanced at the left edge and right edge of the medium 22 and the jamming of the medium is effectively eliminated. It should be noted that the left edge and right edge of the medium 22 are indicated in FIG. 4 to be described later in detail by the reference numerals 22*a* and 22*b*.

The medium 22 thus fed to the printer 20 is printed by a printing head 62 provided inside the printer 20, and the medium 20 thus printed is discharged from the exit slot 64. It should be noted that FIG. 1 further shows a skew sensor 68 that is used for detecting a skew in the medium 22 after the positioning process in the medium positioning mechanism 18.

Figure 2:
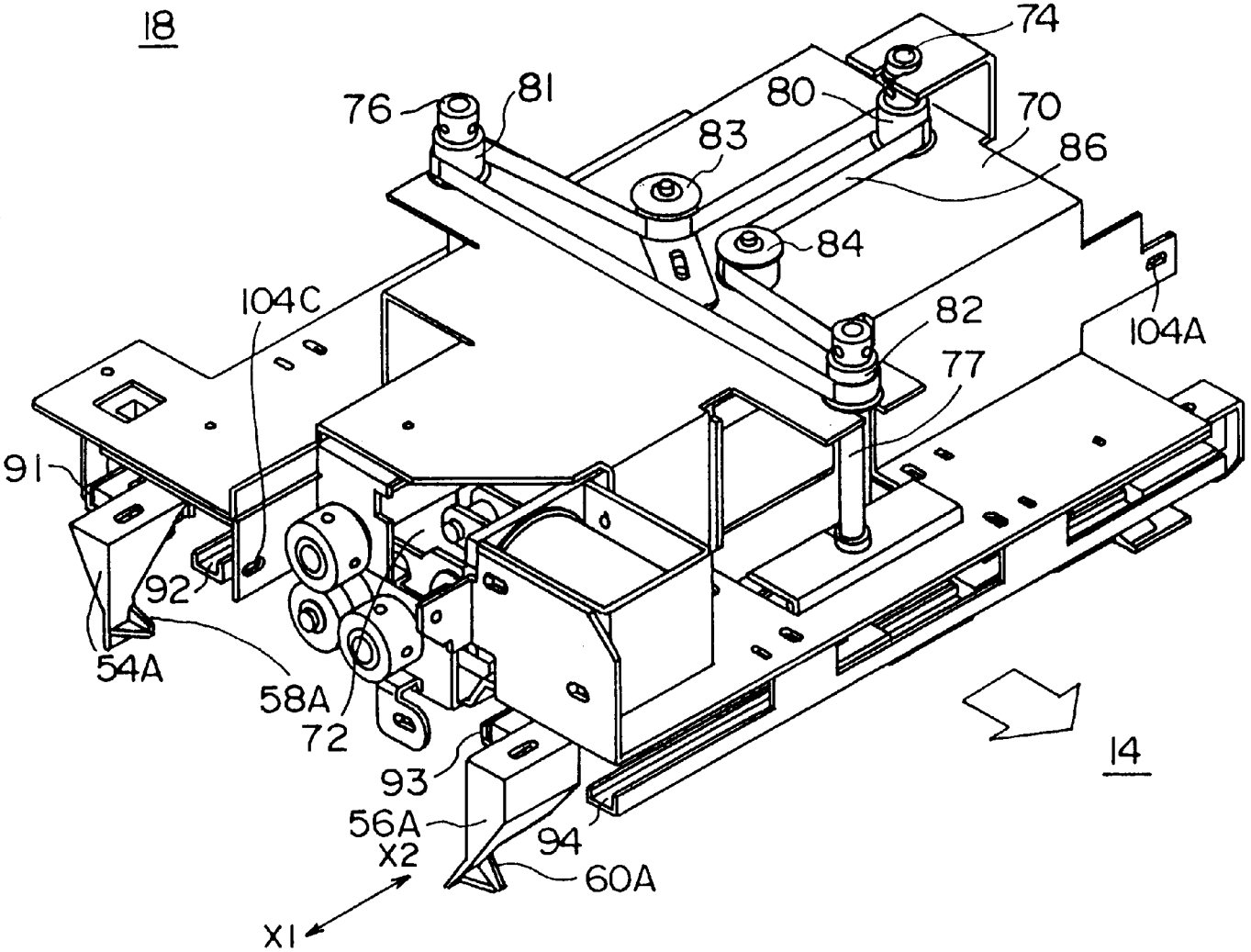
FIG. 2 is a diagram showing a medium positioning mechanism used in the apparatus of FIG. 1 in an oblique view as viewed from an upper direction.
Figure 3:
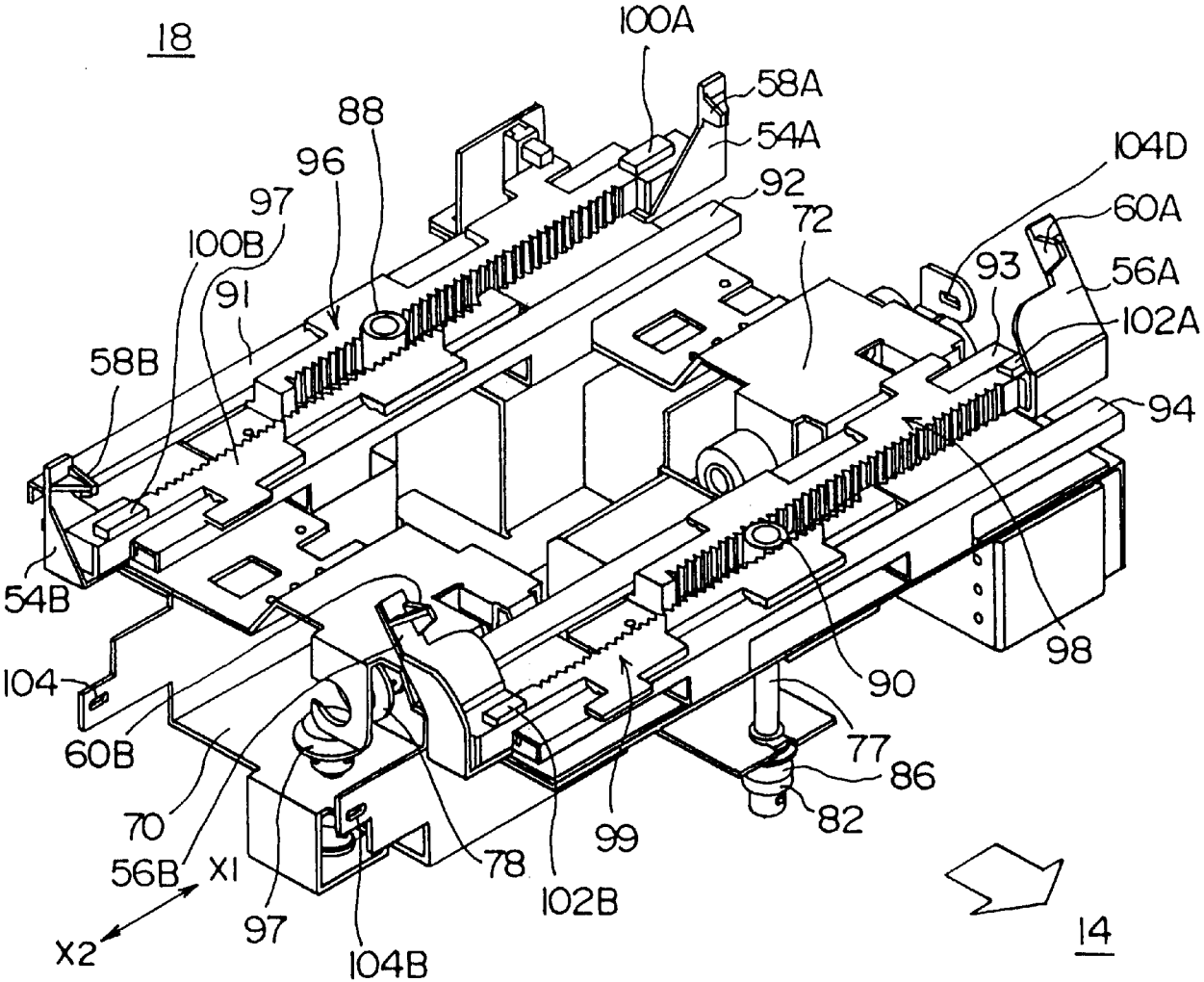
FIG. 3 is a diagram showing the medium positioning mechanism of FIG. 2 in an oblique view as viewed from a lower direction.

Next, the description will be made on the medium positioning mechanism 18 with reference to FIGS. 2 and 3, wherein FIG. 2 shows the medium positioning mechanism 18 in an oblique view as viewed from an upper direction while FIG. 3 shows the medium positioning mechanism 18 in an oblique view as viewed form a lower direction.

Referring to FIGS. 2 and 3, the medium positioning mechanism 18 generally includes a chassis 70 carrying thereon first and second positioning arms 54A, 54B, 56A and 56B, a motor 72, a drive belt 86, first and second pinion gears 88 and 90, first through fourth lack gears 96–99, and lateral positioning sensors 100A, 10B, 102A and 102B. The medium positioning mechanism 18 is designed to form a unit independent from the main body 12 of the printing apparatus 10 such that the medium positioning mechanism 18 is movable with respect to the main body 12 of the printing apparatus 10.

It should be noted that the chassis 70 is formed by a press-forming process a metal plate and carries the drive motor 72 at the underside of the chassis 70 as indicated in FIG. 3, wherein the drive motor 72 drives a helical gear 78 and another helical gear 79 meshing the helical gear 78. The helical gear 79 is provided rotatably on the chassis 70 about a rotary shaft 74 extending generally vertically to the chassis 70, and thus, the shaft 74 is driven by the motor 72.

As indicated in FIG. 2, the shaft 74 projects in the upward direction from the top surface of the chassis 70 and carries a drive pulley 80 thereon. Further, the chassis 70 carries follower shafts 76 and 77 generally at a central part of the medium feed path 14 respectively in the upstream side and downstream side, wherein the followers shafts 76 and 77 carry respective follower pulleys 81 and 82 that are driven by the drive pulley 80 via a drive belt 86. In other words, the rotation of the drive motor 72 is transmitted to the follower shafts 76 and 77 via the helical gears 77 and 78, the drive shaft 74 and the drive belt 86.

It should be noted that the follower shafts 76 and 77 project from the bottom surface of the chassis 70 and carry thereon first and second pinion gears 88 and 89 respectively, wherein the first pinion gear 88 on the shaft 76 meshes first and second lack gears 96 and 97 and the second pinion gear 90 on the shaft 77 meshes third and fourth gears 98 and 99.

Further, it should be noted that the chassis 70 carry first and second sliders 91 and 92 in the upstream side of the medium feed path 14 such that the first and second sliders 91 and 92 extend in the $X_1$–$X_2$ directions. Similarly, the chassis 70 carry third and fourth sliders 93 and 94 extending in the $X_1$–$X_2$ directions in the downstream side of the medium feed path 14.

It should be noted that the first lack gear 96 is guided by the first slider 91 and is movable in the $X_1$–$X_2$ directions. Similarly, the second lack gear 97 is guided by the second slider 92 and is movable in the $X_1$–$X_2$ directions. Further, the third and fourth lack gears 98 and 99 are guided by the third and fourth sliders 93 and 94 respectively and are movable in the $X_1$–$X_2$ directions.

It should further be noted that the first and second lack gears 96 and 97 engage with each other via the first pinion gear 88 intervening therebetween. Similarly, the third and fourth lack gears engage with each other via the second pinion gear 90 intervening therebetween. Thus, the first pinion gear 88 drives the first and second lack gears 96 and 97 in the respective, mutually opposite directions. Similarly, the second pinion gear 90 drives the third and fourth lack gears 98 and 99 in the respective, mutually opposite directions.

More specifically, a counter-clockwise rotation of the first pinion gear 88 causes the first lack gear 96 to move in the $X_2$-direction and the second lack gear 97 in the $X_1$-direction. Similarly, a counter-clockwise rotation of the second pinion gear 90 causes the third lack gear 98 to move in the $X_2$-direction and the fourth lack gear 99 to move in the $X_1$-direction.

The first lack gear 93 carries, at an end thereof facing the $X_1$-direction, a first medium positioning arm 54A projecting in the $X_1$-direction toward the feed path of the medium 22, wherein the arm 54A has a bent part 58A at a tip end thereof forming a contact guide part for contacting the medium 22. Similarly, the second lack gear 97 carries, at an end thereof facing the $X_2$-direction, a second medium positioning arm 54B projecting in the $X_2$-direction toward the feed path of the medium 22, wherein the arm 54B has a bent part 58B at a tip end thereof forming a contact guide part for contacting the medium 22.

Further, the third lack gear 98 carries, at an end thereof facing the $X_1$-direction, a third medium positioning arm 56A projecting in the $X_1$-direction toward the feed path of the medium 22, wherein the arm 56A has a bent part 60A at a tip end thereof forming a contact guide part for contacting the medium 22. Similarly, the fourth lack gear 99 carries, at an end thereof facing the $X_2$-direction, a fourth medium positioning arm 56B projecting in the $X_2$-direction toward the feed path of the medium 22, wherein the arm 56B has a bent part 60B at a tip end thereof forming a contact guide part for contacting the medium 22.

When positioning the medium 22, the first lack gear 96 and the third lack gear 98 are moved in the $X_2$-direction and the second lack gear 97 and the fourth lack gear 99 are moved in the $X_1$-direction. As a result of the movement of the first through fourth lack gears 96–99, the positioning arms 54A and 54B are moved toward a center C of the medium feed path 14 shown in FIG. 4 together with the contact guide parts 58A and 58B. Similarly, the positioning arms 56A and 56B are moved toward the center C together with the contact guide parts 60A and 60B.

Thus, when the medium 22 is transported with an offset from the center C of the medium feed path 14 as shown by a broken line in FIG. 4, the contact guide parts 58A and 58B and the contact guide parts 60A and 60B urge the medium 22 in alignment with the center C as indicated by a continuous line in FIG. 4. In the aligned state, it should be noted that the center of the medium 22 is coincident to the center C of the medium feed path 14.

By using the medium positioning mechanism 18 of the present invention, it becomes possible to use a center-reference printer for the printer 20, and the occurrence of jamming in the medium 22 transported along the medium feed path 14 is successfully avoided.

It should be noted that there is provided a lateral positioning sensor 100A adjacent to the medium feed path 14 such that the lateral positioning sensor 100A is located in the vicinity of the first lack gear 96 corresponding to the end thereof in the $X_1$-direction. Similarly, there is provided another lateral positioning sensor 100B adjacent to the medium feed path 14 such that the lateral positioning sensor 100B is located in the vicinity of the second lack gear 97 corresponding to the end thereof in the $X_2$-direction.

Further, there is provided a lateral positioning sensor 102A adjacent to the medium feed path 14 in the vicinity of the third lack gear 98 corresponding to the end thereof in the $X_1$-direction, and a further lateral positioning sensor 102B is provided adjacent to the medium feed path 14 in the vicinity of the fourth lack gear 99 corresponding to the end thereof in the $X_2$-direction.

Each of the lateral positioning sensors 100A, 100B, 102A and 102B is formed of a non-contact type sensor and detects the medium 22 when the medium 22 has come to an adjacent position.

Further, it should be noted that the chassis 70 is formed with a plurality of adjustment holes 104A–104D at respective, predetermined positions, wherein the adjustment holes 104A–104D are used to insert a mounting bolt not illustrated when the medium positioning mechanism 18 is mounted on the main body 12 of the printing apparatus 10.

As indicated in FIG. 3, each of the adjustment holes 104A–104D has an elongated shape so as to allow a lateral adjustment of the medium positioning mechanism 18 with respect to the main body 12 of the printing apparatus 10. In other words, the adjustment holes 104A–104D function as an adjustment mechanism for adjusting the medium positioning mechanism 18 with respect to the body 12 of the printing apparatus 10. Further, it should be noted that the medium positioning mechanism 18 forms an independent unit with respect to the printing apparatus 10 and can be treated as an independent unit with respect to the body 12 of the printing apparatus 10.

Thus, when the printer 20 is to be replaced with a new printer, it is possible, in the printing apparatus 10 of the present invention, to use a printer of new model by simply adjusting the position of the medium positioning mechanism 18.

It should be noted that, in view of the extremely severe operational condition and/or environment of the printing apparatus 10, which is used typically in a public place for issuing various certificates and bankbooks to various users, the lifetime of the printer 20 is only one or two years. On the other hand, the medium positioning mechanism 18 may have a lifetime of six to ten years. Thus, there inevitably comes the time of replacing the printer 20. In the printing apparatus 10 of the present invention, it should be noted that the printing apparatus 10 can use a new, high-performance printer for the replacement of the printer 20 without problem, by merely adjusting the position of the medium positioning mechanism 18.

FIGS. 5 and 6 show the relationship between the medium feed path 14 and the medium positioning arms 54A, 54B, 56A and 56B in the state that the medium positioning mechanism 18 is mounted on the main body 12 of the printing apparatus 10.

As described already, it is necessary for the medium positioning arms 54A and 54B or 56A and 56B to engage the medium 22 in order that the medium positioning mechanism 18 applies the desired lateral positioning to the medium 22 that is transported through the medium feed path 14. Thus, the guide plates 14*a* and 14*b* defining the medium feed path 14 is formed with a mouth 106 and a mouth 108 as indicated in FIGS. 5 and 6 for allowing insertion of the contact guide parts 58A and 58B of the arms 54A and 54B or the contact guide parts 60A and 60B of the arms 56A and 56B into the medium feed path 14.

On the other hand, it should be noted that such a formation of the mouth 106 or 108 in the medium feed path 14 means that the continuously extending guide plates 14*a* and 14*b* shown in FIG. 1 or FIG. 5 are interrupted at the mouth 106 or 108 in correspondence to a gap 109. See FIG. 6. When such an interruption or gap exists in the guide plates 14*a* and 14*b* defining the medium feed path 14, there is a substantial risk that the medium 22 transported through the medium feed path 14 is jammed at the gap 109.

Thus, in order to avoid the problem of jamming of the medium 22 at the gap 109, the guide plates 14*a* and 14*b* are formed such that the mouth 106 or 108 opens in the upstream direction of the medium feed path 14 such the medium 22 crossing the gap 109 is taken up by the opening of the mouth 106 or 108 even when the path of the medium 22 is slightly offset from the predetermined medium feed path 14.

In relation to the shape of the mouth 106 or 108 thus opening in the upstream direction of the medium feed path 14, each of the contact guide parts 58A, 58B, 60A and 60B has a shape such that the size of the contact guide part increases toward the upstream direction of the medium feed path 14 in conformity with the shape of the mouth 106 or 108. By configuring the contact guide parts 58A, 58B, 60A and 60B as such, it is possible to increase the area of the contact guide parts for contacting with the medium 22.

When the contact guide parts 58A and 58B or 60A and 60B are configured in an opposite manner, there is formed a space between the mouth 106 or 108 and the contact guide parts 58A and 58B or 60A and 60B, while the existence of such a space in the medium feed path 14 may cause a deflection in the medium 22 fed through the medium feed path 14.

By configuring the contact guide parts 58A–60B as noted above, it is possible to avoid the formation of such a space in the medium feed path 14 and the occurrence of deflection of the medium 22 is effectively avoided while simultaneously achieving an effective lateral positioning of the medium 22.

Hereinafter, the details of the medium feed path 14 will be described.

As indicated in FIG. 5, the medium feed path 14 has a curved shape with a curvature R in correspondence to the part where the medium positioning mechanism 18 is provided. Further, a drive roller 46 and a retractable roller 50 are disposed adjacent to the medium feed path 14 in the vicinity of the mouth 106. Similarly, a drive roller 48 and a retractable roller 52 are disposed adjacent to the medium feed path 14 in the vicinity of the mouth 108.

By configuring the medium feed path 14 to have the curvature R as noted above, the medium 22 fed through the medium fed path 14 is curved and the rigidity of the medium 22 against the deformation in the $X_1$–$X_2$ direction, which is perpendicular to the direction of medium feeding, is increased. Thereby, the jamming of the medium 22 in the medium feed path 14 is effectively eliminated.

The drive rollers 46 and 48 are driven by a drive motor not illustrated. Further, the retractable rollers 50 and 52 are provided so as to oppose the drive rollers 46 and 48 across the medium 22 respectively, wherein the retractable rollers 50 and 52 are carried on respective movable levers 51 and 53. Thus, when the levers 51 and 53 are rotated in the $C_1$-direction as indicated in FIG. 5, the retractable rollers 50 and 52 are engaged with the drive rollers 46 and 48 across the medium 22 and the feeding of the medium 22 is continued. When the levers 51 and 53 are rotated in the $C_2$-direction, on the other hand, the rollers 50 and 52 are disengaged from the medium 22.

By configuring the rollers 50 and 52 retractable as such, the medium positioning mechanism 18 can move the medium 22 laterally in alignment to the desired reference position by using the contact guide parts 58A and 58B or 60A and 60B. When the rollers 50 and 52 are in engagement with the drive rollers 46 and 48 via the medium 22, it should be noted that the lateral movement of the medium 22 by the medium positioning mechanism 18 is not possible.

In the illustrated example of FIG. 5, the rotation of the lever 51 or 53 in the $C_1$–$C_2$ direction is achieved by a solenoid 40 shown in FIG. 1.

It should be noted that the solenoid 40 is the device used also for controlling the lock lever 36 of the double-feed detection mechanism 16, as explained before. Thus, the levers 51 and 53 share the mechanism of the double-feed detection mechanism 16 partially, and thus, the medium positioning mechanism 18 is disposed in the vicinity of the double-feed detection mechanism 16 at the downstream side of the medium feed path 14. The foregoing construction of the present embodiment is advantageous for reducing the size of the main body 12 and the cost of the printing apparatus 10 as compared with the construction in which the medium positioning mechanism 18 and the double-feed detection mechanism 16 are provided separately.

Next, the operation of the printing apparatus 10 will be described. In view of the characteristic feature of the present invention residing in the double-feed detection mechanism 16 and the medium positioning mechanism 18, the description hereinafter will be made only for the operation of these mechanisms 16 and 18.

Figure 7:
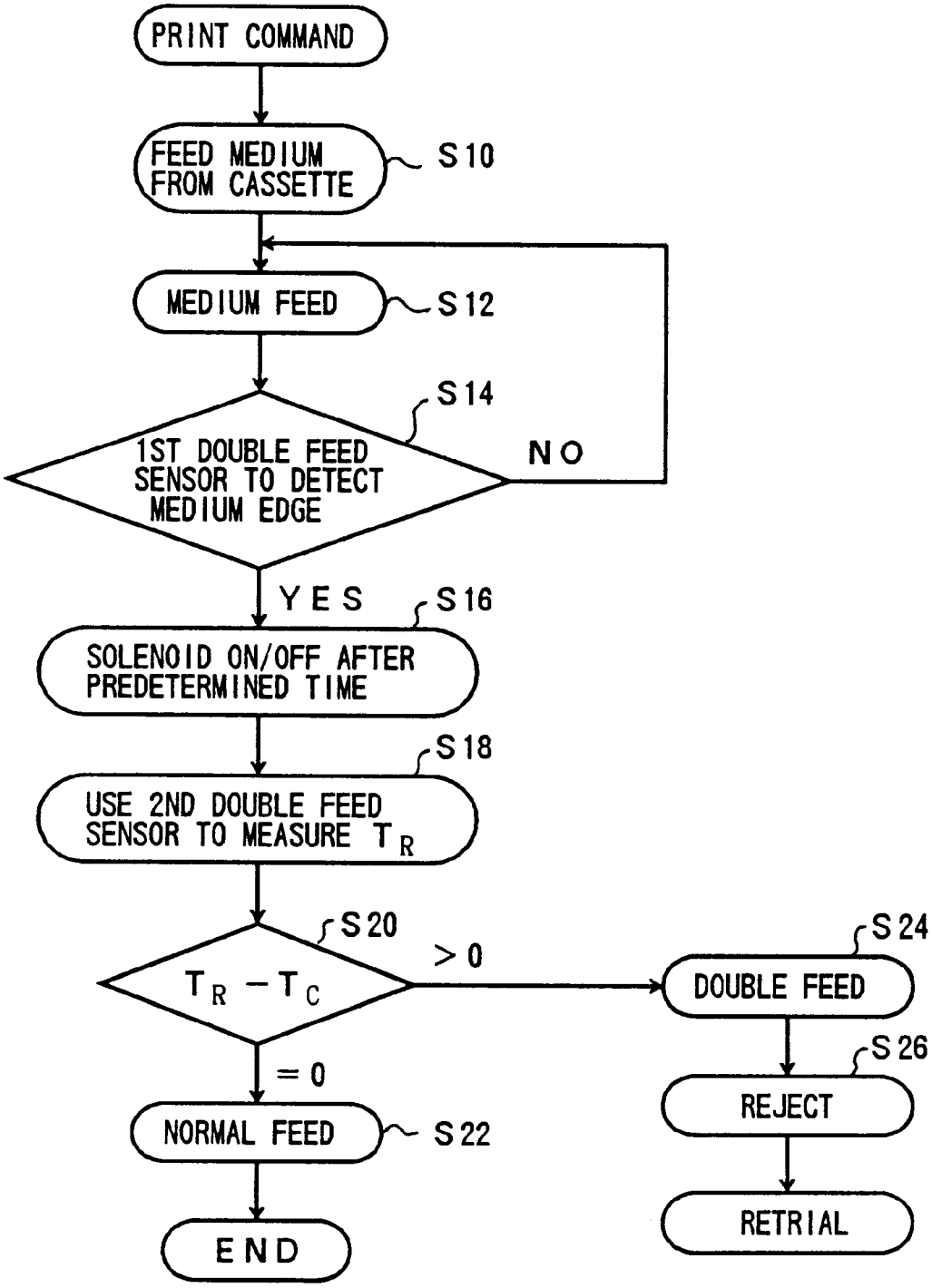
FIG. 7 is a flowchart explaining the operation of a double-feed detection mechanism used in the medium processing apparatus of the present invention.

FIG. 7 shows the flowchart of the operation of the double-feed detection mechanism 16 conducted by a microprocessor not illustrated.

Referring to FIG. 7, the process starts with a printing command which may be issued when the user of the printing apparatus 10 actuates a switch or in response to an instruction from a host computer.

In the first step S10, a medium 22 is let out from one of the cassettes 24A–24D to the medium feed path 14 in correspondence to the printing command, and the medium 22 thus let out is forwarded to the double-feed detection mechanism 16 in the next step S12 along the medium feed path 14.

Next, in the step S14, the rear edge of the medium 22 is detected based upon the signal from the first double-feed sensor 42, wherein the detection of the step S14 is continued until the result of the detection becomes YES in the step S14, indicating that the rear edge of the medium 22 is detected.

When the result of the step S14 is YES, the process proceeds to the step S16 and the solenoid 14 is energized. As described already, the solenoid 40 is used both by the double-feed detection mechanism 16 and the medium positioning mechanism 18, and thus, the solenoid 40 actuates both the lock lever 36 and the levers 51 and 53 carrying the retractable rollers 50 and 52. When the solenoid 40 is actuated, the lock roller 30 is prevented from rotating by the lock lever 36 and the retractable rollers 50 and 52 are retracted in the $C_2$-direction as indicated in FIG. 5.

When there occurs a double feeding of the medium 22 in the medium feed path 14 such that a medium 22 is overlapped on another medium 22, the double feed detection mechanism 16 separates the upper medium 22 from the lower medium 22 by forwarding the upper medium 22 while holding the lower medium 22. Further, the medium positioning mechanism 18 becomes ready to achieve the lateral positioning of the medium 22 as a result of the retractable rollers 50 and 52 retracted from the medium feed path 14. The solenoid 40 is then deenergized when the lateral positioning of the medium 22 is completed.

Next, in the step S19, the time $T_R$ needed for the medium 22 to pass over the second double-feed sensor 44 is measured based on the output signal of the sensor 44, and the time $T_R$ thus measured is compared in the step S20 with a predetermined nominal time $T_C$ which is needed for the medium 22 to pass over the sensor 44 when there is no double-feeding. More specifically, the step S20 calculates a time difference $T_R$–$T_C$ and discriminates whether or not the time difference thus obtained is zero ($T_R$–$T_C$=0) or larger than zero ($T_R$–$_C$)T.

When it is judged in the step S20 that the time difference is zero, the microprocessor of the control unit judges that the medium 22 is transported properly, and the operation of the double-feed detection mechanism 16 is terminated.

When the time difference exceeds zero ($T_R$–$T_C$>0), on the other hand, this means that there is a double feed in the transport of the medium 22, and the process proceeds to the step S24. When there is a double feed, it should be noted that the upper medium 22 and the lower medium 22 are separated from each other by the drive roller 28 and the lock roller 30, and the double-feed sensor 44 detects the passage of the upper and lower media 22. Thereby, the time $T_R$ in which the sensor 44 detects the upper and lower media 22 increases inevitably.

When it is judged in the step S24 that there occurs a double-feeding in the transport of the medium 22, a rejection process is carried out in the step S26 in which the double-fed media 22 are forwarded to a reject box 66. Thereby, it should be noted that the forwarding of the medium 22 to the printer 20 is prevented and the erroneous printing on the medium 22 or occurrence of jamming is avoided. The rejected medium 22 is returned to the any of the cassettes 24A–24D for retrial.

Figure 8:
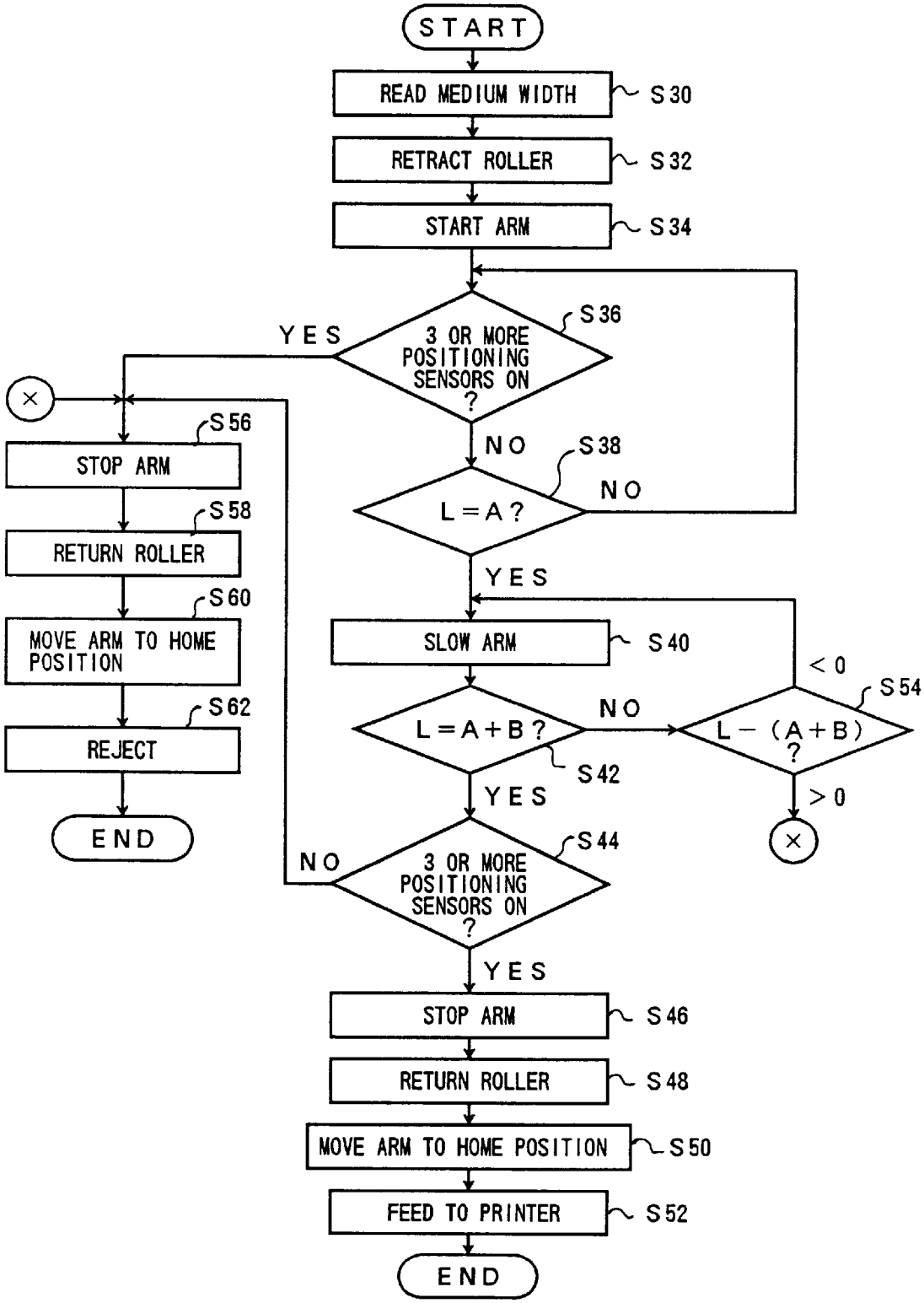
FIG. 8 is a flowchart explaining the operation of the medium positioning apparatus of FIGS. 2 and 3.

Next, the operation of the medium positioning mechanism 18 will be described with reference to FIGS. 4 and 8, wherein FIG. 8 shows the flowchart of the operation controlled by a microprocessor.

Referring to FIG. 8, the process starts with a printing command and the data on the width of the medium 22 is read in the step S30 from a storage medium that cooperates with the processor.

Next, in the step S32, the solenoid 40 is energized and the retractable rollers 50 and 52 are retracted similarly to the step S16 of FIG. 7. Thereby, the medium 22 is stopped at a predetermined stop position ST shown in FIG. 4.

Next, the drive motor 72 is activated and the positioning arms 54A and 54B and the positioning arms 56A and 56B are started to move. With this, the contact guide parts 58A and 60A are caused to move in the $X_2$-direction from a predetermined home position HP. Further, the contact guide parts 58B and 60B are caused to move in the $X_1$-direction from a predetermined home position HP.

Next, the step 36 is conducted in which a discrimination is made whether or not three or more of the lateral positioning sensors 100A and 100B and 102A and 102B detect the medium 22, based upon the output of the sensors 10A, 100B, 102A and 102B.

As noted already, the lateral positioning sensors 10A, 10GB, 102A and 102B are provided on the first through fourth lack gears 96–99 at both lateral sides of the medium feed path 14. Thus, it becomes possible to detect the erroneous insertion of the medium 22 with a high precision by using the medium positioning mechanism 18.

When the result of the step S36 is NO, a discrimination is made in the step S38 as to whether or not the medium contact guide parts 58A, 58B, 60A and 60B have reached a predetermined slowdown position (SDP) shown in FIG. 4.

More specifically, the distance L which any of the medium contact guide parts 58A, 58B, 60A and 60B have moved can be detected by counting the number of steps of the drive motor 72. As the distance A from the home position HP to the slowdown position SDP is known, it is possible to discriminate whether or not the medium contact guide parts 58A, 58B, 60A and 60B have reached the slowdown point SDP, by checking whether or not the condition L=A is met. The steps 36 and 38 are continued until the result of the step S38 becomes YES.

When the result of the step S36 has become YES, the process steps of the steps S56–S62 are carried out. It should be noted that the result of the step S36 becomes YES when three or more lateral positioning sensors have detected the medium 22 in the state in which the medium contact guide parts 58A, 58B and 60A, 60B have not reached the slowdown position SDP.

Suppose that the medium 22 is transported with an offset in the $X_2$-direction from the center-reference position and has stopped at the position ST as indicated in FIG. 4 by the broken line. This offset of the medium 22 is called a normal offset state in the sense that both lateral edges 22*a* and 22*b* of the medium 22 are parallel to the center C of the medium feed path 14. In such a normal offset state of the medium 22, either the lateral positioning sensors 100A and 102A at the $X_1$-side or the lateral positioning sensors 100B and 102B at the $X_2$-side should detect the medium 22 when the medium contact guide parts 58A and 58B and the medium contact guide parts 60A and 60B are moved toward the center C of the medium feed path 14.

In the example of FIG. 4 in which the medium 22 is offset in the $X_2$-direction with respect to the center C (normal offset), the lateral positioning sensors 100B and 102B provided in the vicinity of the contact guide parts 58B and 60B detect the medium 22 when the contact guide parts 58A and 58B and the contact guide parts 60A and 60B are moved toward the center C of the medium, while the lateral positioning sensors 100A and 102A, provided in the vicinity of the contact guide parts 58A and 60A, should not detect the medium 22.

In the case the result of the step S36 is YES, on the other hand, the medium 22 is not in the normal offset state as noted above but is in an oblique state with respect to the feeding direction of the medium 22. Such a skewed state is called "abnormal transport state." When the lateral positioning is applied to the medium 22 in such an abnormal transport state, there is a substantial risk that the medium 22 deflects and causes a severe jamming.

Thus, when such an abnormal transport is detected in the step S36, the process proceeds to the step S56 for interrupting the movement of the positioning arms 54A and 54B or 56A and 56B, and the step S58 is conducted further in which the retracted rollers 50 and 52 are returned to the original position. Further, the step S60 is conducted in which the medium positioning arms 54A and 54B as well as the medium positioning arms 56A and 56B are returned to the home position. Finally, the medium 22 thus caused the problem of abnormal transport is forwarded to the rejection box 66 and the process is terminated. The steps S56–S62 are called rejection processing steps.

When the result of the step S36 is NO and the result of the step S38 has become YES, on the other hand, the process proceeds to the step S40, and the moving speed of the arms 54 and 54B as well as the moving speed of the arms 56A and 56B are reduced. For example, the moving speed of the arms 54A, 54B, 56A and 56B may be reduced to one-half the speed V in the area designated in FIG. 4 by the arrow A, when the arms have entered the area B between the home position HP and the slowdown position SDP.

By reducing the moving speed of the medium positioning arms 54A, 54B, 56A and 56B as such, the problem of deflection of the medium 22 and associated jamming of the medium 22 are reduced substantially as compared with the case in which the arms are moved with a uniform speed throughout the entire regions A and B. As the arms are moved at the high speed V in the region A, the present invention can also reduce the time for the lateral positioning of the medium 22 as compared with the case in which the arms are moved with a slow speed throughout the regions A and B.

Next, in the step 42, a discrimination is made whether or not the moving distance L of the contact guide parts 58A, 58B, 60A and 60B as measured from the home position HP has become identical to the distance A+B corresponding to the center-reference position. If the result of the step S42 is NO, the process proceeds to the step 54 and a further discrimination is made as to whether or not the condition L-(A+B)<0 is met. If the foregoing condition is met, this means that the medium contact guide parts 58A and 58B or 60A and 60B have not reached position corresponding to the center-reference position, and the process returns to the step S40. On the other hand, if the foregoing condition does not hold, which means that there holds a relationship L-(A+B) >0, the medium 22 has been moved laterally beyond the center-reference position and there is a substantial possibility that the medium 22 has caused an abnormal feeding. Thus the process proceeds to the step S56 for the rejection processing.

When the result of the step S42 is YES, on the other hand, the process proceeds to the step S44 and the output signals of the lateral positioning sensors 10A, 100B, 102A and 102B are detected. Thereby, the step S44 carries out a discrimination process whether or not three or more of the foregoing four sensors have been turned on, indicating that the detection of the medium 22 is made.

It should be noted that the discrimination result of the step S42 becomes YES when the contact guide parts 58A, 58B, 60A and 60B are moved to the respective positions corresponding to the center-reference position. Thus, as long as the contact guide parts 58A, 58B, 60A and 60B carry out an appropriate positioning of the medium 22, the result of the step S42 should become YES.

When the result of the step S44 is NO, on the other hand, this means that the sensors 100A, 100B, 102A and 102B cannot detect the positioning of the medium 22 to the desired center-reference position, in spite of the fact that the contact guide parts 58A, 58B, 60A and 60B are moved to the respective positions corresponding to the center-reference position. Thus, whenever the result of the discrimination of the step S44 becomes NO, there is a possibility of jamming in the medium 22, and the process jumps to the rejection processing of the step S56.

Further, when the result of the discrimination in the step S44 is YES, this means that the medium 22 is properly positioned to the center-reference position. Thus, when it is confirmed that the medium 22 is positioned to the desired center-reference position, the process proceeds to the step S46 for ceasing the movement of the arms 54A, 54B as well as the arms 56A and 56B, and the retracted rollers 50 and 52 are returned to the respective original positions in the step S48. Further, the arms 54A, 54B, 56A and 56B are returned to the home position in the step S50. Finally, the medium 22 thus positioned in alignment to the center-reference position is forwarded to the printer 20 and the operation of the medium positioning mechanism 18 is terminated.

It should be noted that the present application is based on Japanese priority application No.10-070776 filed on Mar. 19, 1998, the entire contents of which are hereby incorporated by reference.

Further, the present invention is not limited to the embodiments described heretofore, but various variations and modifications may be made without departing from the scope of the invention.

What is claimed is:

1. A medium processing apparatus, comprising:

a main body:

a medium feed path provided in said main body of said medium processing apparatus;

a medium positioning mechanism provided in said main body of said medium processing apparatus adjacent to said medium feed path, said medium positioning mechanism causing a centering of said medium in said medium feed path; and a medium processing unit provided in said main body of said medium processing apparatus adjacent to said medium feed path, wherein said medium positioning mechanism forms a unit independent from said main body of said medium processing apparatus, and wherein said medium positioning mechanism includes an adjustment mechanism for adjusting a position of said medium positioning mechanism with respect to said main body of said medium processing apparatus.

2. A medium processing apparatus as claimed in claim 1 further including a double-feed detection mechanism and a roller retract mechanism provided in said main body of said medium processing apparatus adjacent to said medium feed path, wherein said medium positioning mechanism is disposed in a downstream side of said medium feed path with respect to said double-feed detection mechanism, and wherein a part of said double-feed detection mechanism is shared commonly with said roller retract mechanism, said double-feed detection mechanism detecting an overlapped feeding of said medium through said medium feed path, said roller retracting mechanism retracting a roller away from said medium feed path.

3. A medium processing apparatus as claimed in claim 1, wherein said medium feed path has a curved shape at a part thereof where said medium positioning mechanism is provided.

4. A medium processing apparatus as claimed in claim 1, wherein said medium positioning mechanism includes a pair of movable arms laterally movable toward said medium in said medium feed path, said medium feed path including a pair of generally parallel guide plates disposed so as to define said medium feed path therebetween, and wherein said guide plates form a mouth in correspondence to said medium positioning mechanism for accepting said arms, said mouth being opened in an upstream direction of said medium feed path with an increasing width toward said upstream direction, and wherein each of said movable arms carry an end part adapted to be accepted by said mouth.

5. A medium processing apparatus as claimed in claim 4, wherein said medium processing apparatus has a drive motor which causes a movement in said movable arms such that said arms are moved with a first speed from a first, home position to a second position closer to a center of said medium feed path and with a second, slower speed from said second position to a third, predetermined position further closer to said center of said medium feed path.

6. A medium positioning device for positioning a medium transported through a medium feed path in a medium processing apparatus, said medium positioning device comprising:

a pair of movable arms disposed at both lateral sides of said medium feed path for urging a medium in said medium feed path toward a center of said medium feed path;

drive mechanism for driving said movable arms; and an adjustment mechanism for adjusting a position of said medium positioning device with respect to a main body of said medium processing apparatus.

7. A medium positioning device as claimed in claim 6, further comprising error sensors at both lateral sides of said medium feed path for detecting erroneous feeding of said medium through said medium feed path.

* * * * *